US006595880B2

(12) United States Patent
Becker

(10) Patent No.: US 6,595,880 B2
(45) Date of Patent: Jul. 22, 2003

(54) FLUTED ARROW

(76) Inventor: Phillip R. Becker, 26955 130th St., Staples, MN (US) 56479

( * ) Notice: Subject to any disclaimer, the term of this patent is extended or adjusted under 35 U.S.C. 154(b) by 0 days.

(21) Appl. No.: 09/910,238

(22) Filed: Jul. 20, 2001

(65) Prior Publication Data

US 2003/0017892 A1 Jan. 23, 2003

(51) Int. Cl.[7] ..... F42B 6/04; F41B 5/22
(52) U.S. Cl. ..... 473/578; 124/44.5
(58) Field of Search ..... 124/44.5; 473/578

(56) References Cited

U.S. PATENT DOCUMENTS

| | | | | | |
|---|---|---|---|---|---|
| 2,125,591 | A | | 8/1938 | Smith | |
| 2,905,166 | A | * | 9/1959 | Niemeyer | 124/91 |
| 3,751,037 | A | | 8/1973 | Courneya | |
| 3,890,951 | A | | 6/1975 | Jennings et al. | |
| 3,968,784 | A | * | 7/1976 | Miller | 473/578 X |
| 5,025,773 | A | | 6/1991 | Hintze et al. | |
| 5,253,633 | A | | 10/1993 | Sisko | |
| 5,273,293 | A | * | 12/1993 | Lekavich | 473/578 |
| 5,361,747 | A | * | 11/1994 | Laabs | 124/91 |
| 5,526,800 | A | | 6/1996 | Christian | |
| 5,529,049 | A | | 6/1996 | Antalosky | |
| 5,535,728 | A | * | 7/1996 | Prodigo | 124/44.5 |
| 5,673,678 | A | * | 10/1997 | Savage | 124/44.5 |
| 6,017,284 | A | * | 1/2000 | Giles | 473/578 |
| 6,129,642 | A | * | 10/2000 | Dontigny | 473/578 |

* cited by examiner

*Primary Examiner*—John A. Ricci
(74) *Attorney, Agent, or Firm*—Gerald E. Helget; Nelson R. Capes; Briggs and Morgan

(57) ABSTRACT

The present invention relates to an archery arrow with a fluted or crimped shaft, which can be made lighter and hence provide greater velocity than a standard, non-fluted arrow. In a second aspect, the present invention includes a fluted arrow wherein the fluting includes grooves that spiral along the length of the shaft, allowing spin to be imparted to the arrow. Spinning the arrow about its shaft will give it increased stability. In another aspect, the present invention includes an arrow rest for the fluted arrow, which is suitably arranged to impart spin to the arrow and/or to keep the arrow from falling off the arrow rest.

16 Claims, 5 Drawing Sheets

15
11
10
2
3
20
12
16

FLUTED ARROW

BACKGROUND OF THE INVENTION

The present invention relates to an archery arrow with a fluted portion, and an arrow rest suitable for the fluted arrow.

It is well known that a plain piece of sheet metal is not as strong as one that is formed by stamping or bending. This property of metals applies to tubes as well. A straight tube is not as strong as a crimped tube. For two tubes of equal gauge, the crimped tube will be able to take more stress along its length and from pressure on its circumference. This is an application of the "Eggshell" theory. A crimped tube of smaller gauge will be able to handle greater stresses than a tube that isn't crimped of a heavier gauge. The smaller tube will also be lighter assuming the lengths are the same.

SUMMARY OF THE INVENTION

The present invention relates to an archery arrow with a fluted or crimped shaft, which can be made lighter and hence provide greater velocity than a standard, non-fluted arrow.

In a second aspect, the present invention includes a fluted arrow wherein the fluting includes grooves that spiral along the length of the shaft, allowing spin to be imparted to the arrow. Spinning the arrow about its shaft will give it increased stability.

In another aspect, the present invention includes an arrow rest for the fluted arrow, which is suitably arranged to impart spin to the arrow and/or to keep the arrow from falling off the arrow rest.

In another aspect, the arrow of the present invention may have less fletching than that of a standard arrow, because the spin imparted to the arrow reduces or may eliminate the need for fletching. With less fletching, there is less wind resistance, less susceptability to coming in contact with something in flight, and less noise in handling the arrow.

In another aspect, the arrow of the present invention includes a nock adapter and a special nock attachable to the nock adapter that interacts with a nock receiver attached to the bowstring to impart spin to the arrow. The special nock also lessens the problem of the arrow falling off the bow string when the hunter lets down his draw to take a break from a full draw. Also, the nock cannot get plugged with dirt.

DETAILED DESCRIPTION OF THE PREFERRED EMBODIMENT

Figure 4:
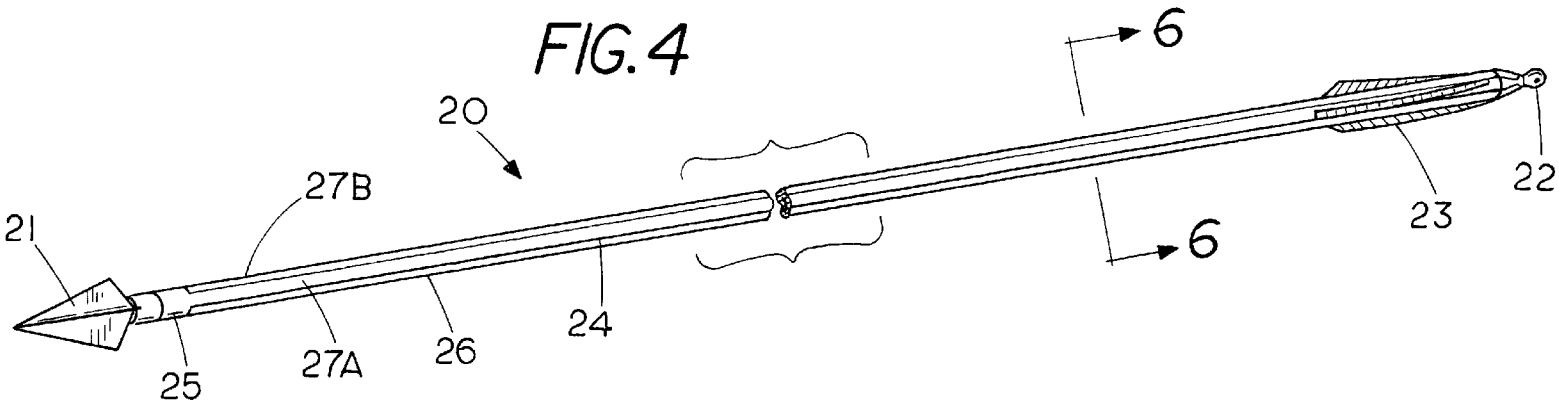
FIG. 4 is a schematic perspective of a first embodiment of the arrow of the present invention.

A first embodiment of the arrow 20 of the present invention is shown in FIG. 4. The arrow 20 comprises an elongate shaft 24, a fletching portion 23 at a first end of the shaft, a tip portion 25 at a second end of the shaft, and wherein the shaft 24 has a fluted portion 26 between the tip portion 25 and the fletching portion 23.

Figure 6:
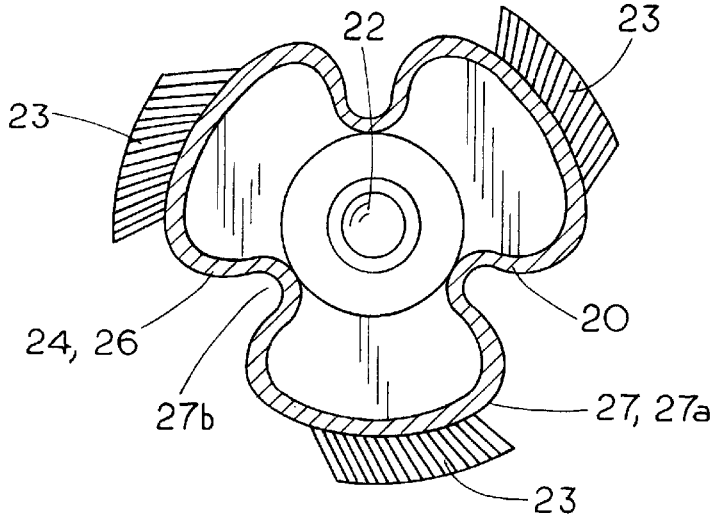
FIG. 6 is a cross-section taken approximately at the lines 6 of FIG. 4.

As best seen in FIG. 6, the fluted portion 26 has a perimeter 27 further comprising a plurality of grooves 27B and separating a plurality of lobes 27A. Preferably, there are three lobes and three grooves. Most preferably, the lobes are equidistantly spaced from one another about the perimeter.

In the preferred embodiment, the shaft 24 is hollow.

Figure 5:
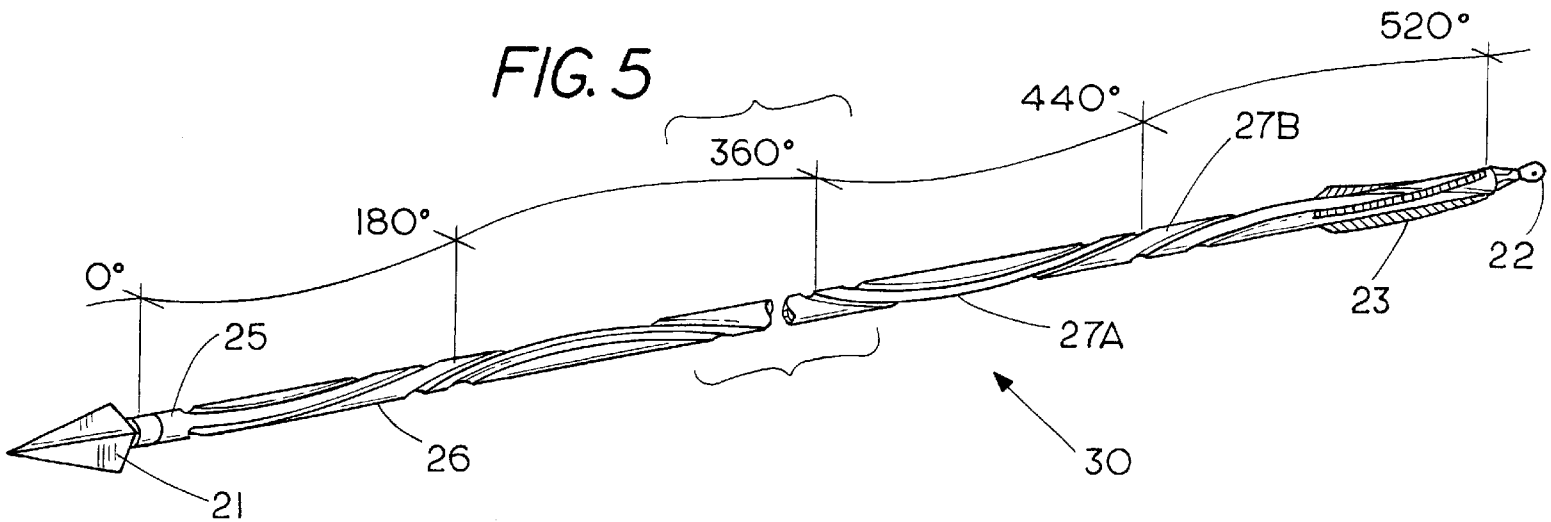
FIG. 5 is a schematic perspective of a second embodiment of the arrow of the present invention.

A second embodiment of the arrow 30 is shown in FIG. 5, in which the fluted portion 26 has lobes 27A and grooves 27B that spiral along the the shaft, thereby imparting spin to the arrow.

Both embodiments also include an attachable arrowhead 21 and a nock 22.

Figure 7:
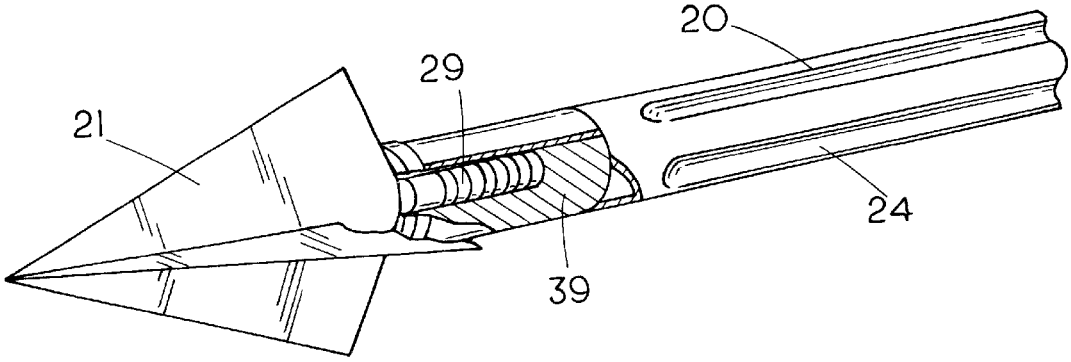
FIG. 7 is a partial perspective view of the tip portion of the arrow showing an arrowhead insert.

Details of attachment of the arrowhead 21 are shown in FIG. 7, where it can be seen that the arrowhead 21 preferably has a threaded portion 29 that engages a non-fluted tip portion 39 in the arrow shaft 24. This allows the archer to use his current favorite arrowhead with a currently standard sized insert for holding the arrowhead 21 or broadhead to the arrow, reducing the necessity for re-tooling.

Figure 8:
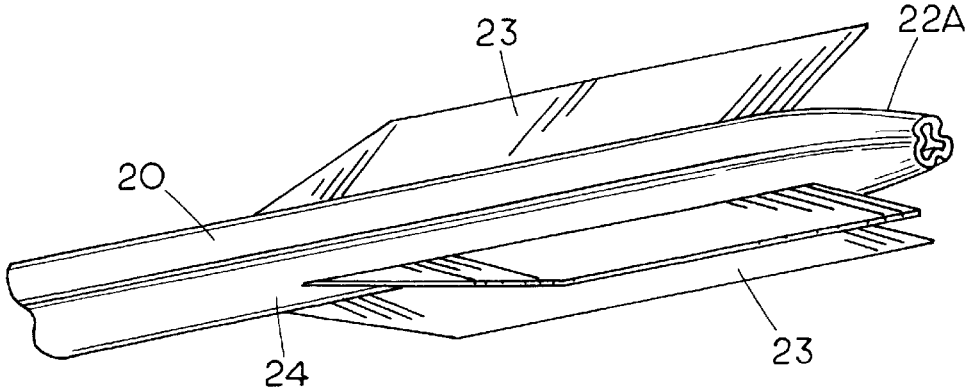
FIG. 8 is a partial perspective view of the fletching portion of the arrow without an attached nock.

Details of the nock are shown in FIG. 8. The nock 22 is attachable to a nock adapter 22A in the fletching portion 23.

Figure 3:
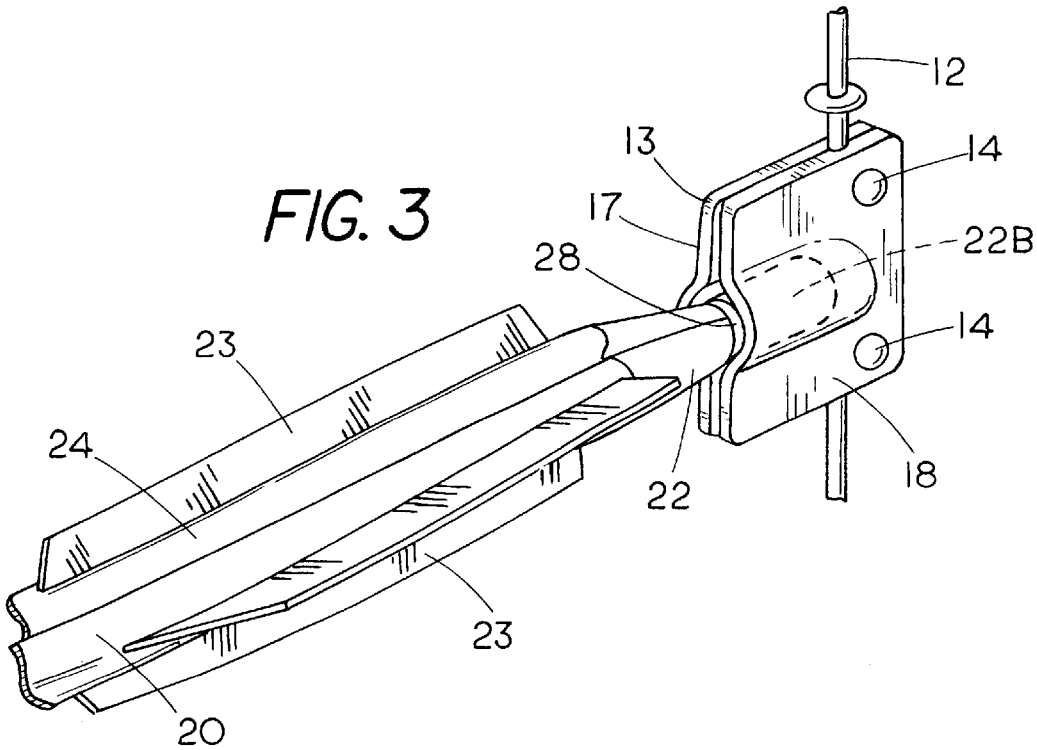
FIG. 3 is a detailed view of the area designated "3" in FIG. 1.

As can be seen in FIGS. 10–13, the nock 22 comprises an enlarged portion 22B. Turning to FIG. 3, it can be seen that the enlarged portion 22B is received in a nock receiver 13 which is attachable to the bow string 12. It can be seen that the enlarged portion 22B is rotatable within the nock receiver 13 to allow the arrow to spin about its length as it is shot from the bow. The nock receiver 13 may be made of two sides 17, 18 joined together by fasteners 14, such as machine screws. A teflon washer 28 or other suitable bearing surface on the nock 22 may facilitate rotation of the arrow.

Figure 1:
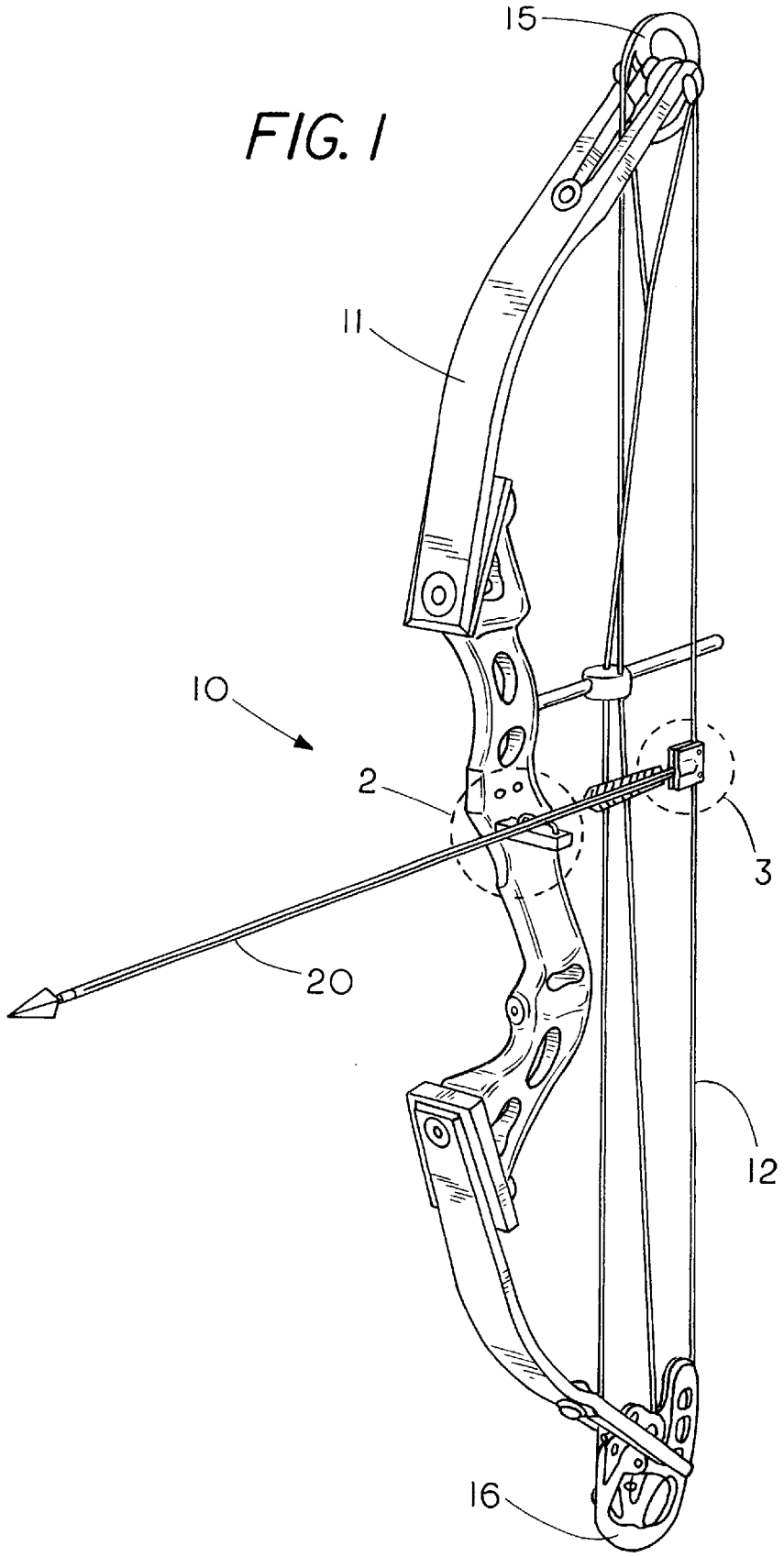
FIG. 1 is a perspective view of an archery bow with the arrow of the present invention.
Figure 2:
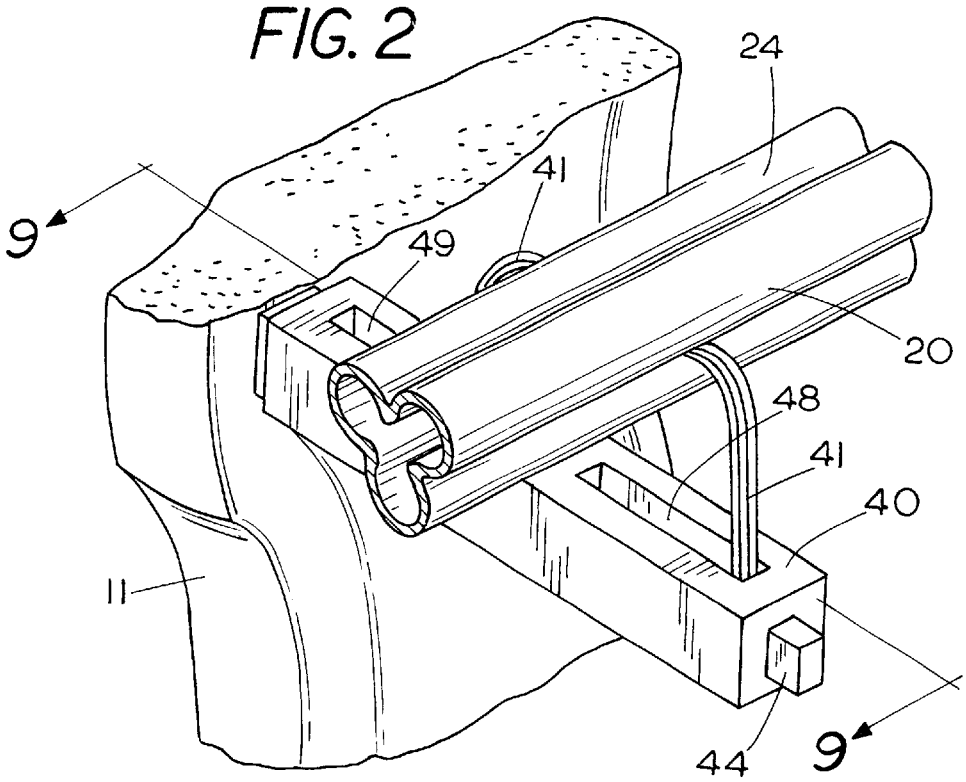
FIG. 2 is a detailed view of the area designated "2" in FIG. 1.
Figure 9:
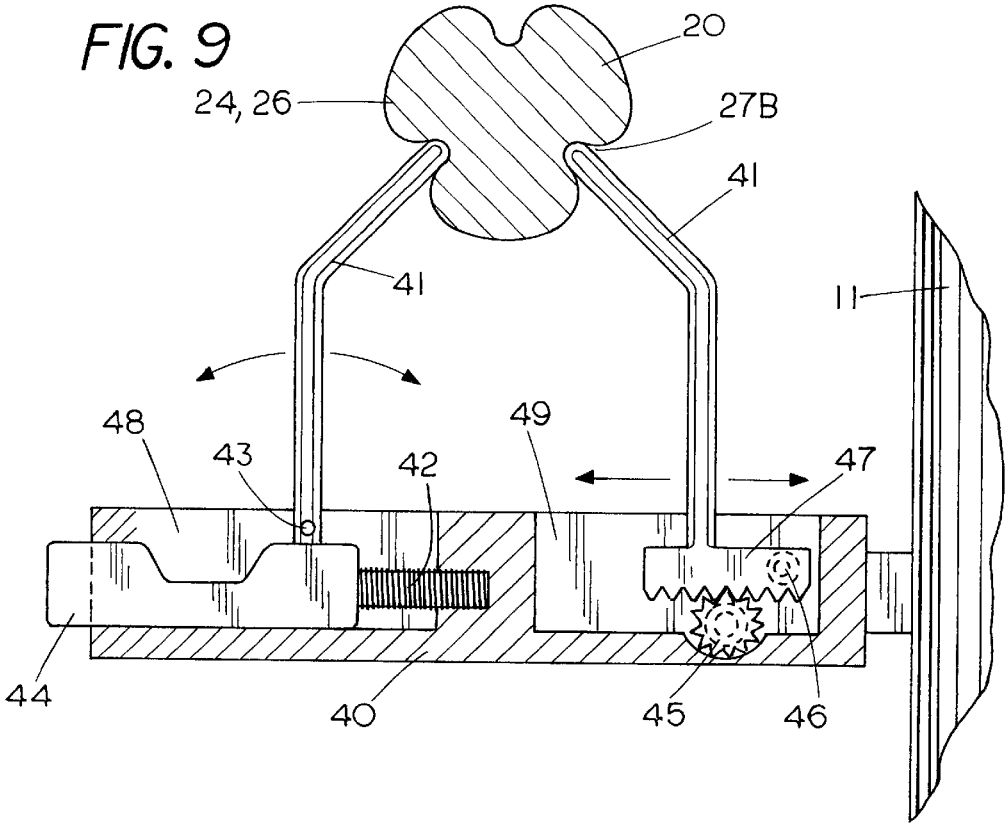
FIG. 9 is a cross-section taken at approximately the lines 9 of FIG. 2.
Figure 10:
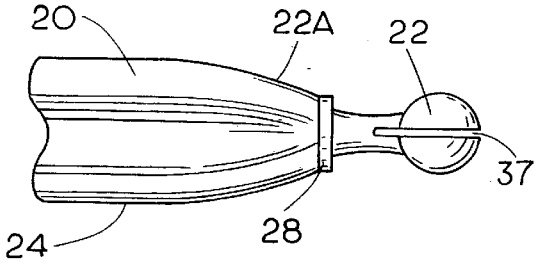
FIG. 10 is an elevational view of a first embodiment of a nock attached to the arrow.
Figure 11:
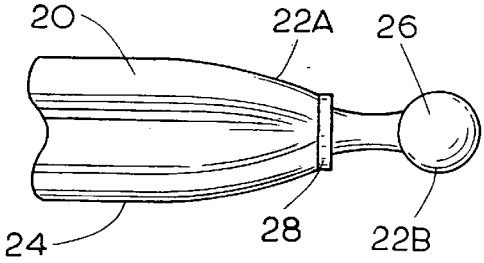
FIG. 11 is an elevational view of a second embodiment of a nock attached to the arrow.
Figure 12:
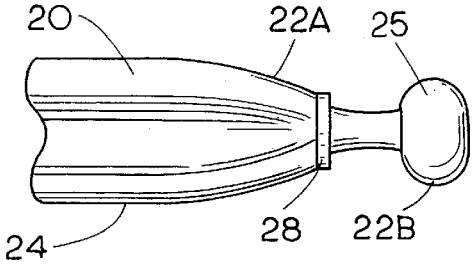
FIG. 12 is an elevational view of a third embodiment of a nock attached to the arrow.
Figure 13:
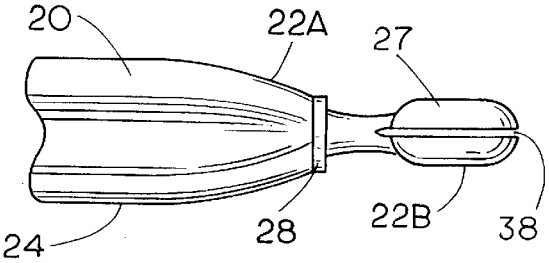
FIG. 13 is an elevational view of a fourth embodiment of a nock attached to the arrow.

An arrow rest for use with the arrow of the present invention is shown in FIGS. 2 and 9. The arrow rest comprises a base portion 40 adapted to be attached to an archery bow 11. A first supporting finger 41 is attached to the base 40 and is adapted to engage the arrow's fluted portion 26. The finger 41 is pivotable on the base 40 and a spring 42 biases the finger 41 against the arrow's fluted portion 26. A release 44 allows the first finger 41 to be pivoted away from the arrow to remove the arrow from the arrow rest. The release is movable within the release slot 48. A second supporting finger 41 is also biased to engage the arrow's fluted portion 26. A ratchet 47 is adapted to adjustably bias the second supporting finger 41 against the arrow's fluted portion 26. The ratchet is movable within the rack slot 49.

In use, the archer lays the fluted portion of the arrow 26 against the fingers 41 so that the fingers 41 engage the grooves 27B of the arrow. In this position, the arrow 20 is held firmly in place and cannot fall off the arrow rest.

In the case of the second embodiment of the arrow 30, the engagement of the fingers 41 with the spiraled grooves of the arrow causes the arrow to spin as it is released from the bow.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. An archery arrow having an elongate shaft, a fletching portion at a first end of the shaft, and a tip portion at a second end of the shaft, wherein the shaft has a fluted portion between the tip portion and the fletching portion, wherein the lobes and grooves spiral along the shaft, thereby imparting spin to the arrow and wherein the shaft is tapered at the fletching portion to form a nock adapter, and further comprising a nock attachable to the nock adapter, the nock further comprising an enlarged portion, and further comprising a nock receiver for receiving the enlarged portion, the nock receiver being adapted for attachment to an archery bow string, the nock being rotatable within the nock receiver to allow the arrow to spin about its length.

2. The arrow of claim 1, wherein the fluted portion has a perimeter, and wherein the perimeter further comprises a plurality of grooves separating a plurality of lobes.

3. The arrow of claim 1, further comprising three lobes and three grooves.

4. The arrow of claim 3, wherein the lobes are equidistantly spaced about the perimeter.

5. The arrow of claim 1, wherein the shaft is hollow.

6. The arrow of claim 1, further comprising a non-fluted tip portion adapted to receive an arrowhead.

7. In combination, an archery arrow having an elongate shaft, a fletching portion at a first end of the shaft, and a tip portion at a second end of the shaft, wherein the shaft has a fluted portion between the tip portion and the fletching portion, and in arrow rest engaging the arrow, wherein the fluted portion has a perimeter, and wherein the perimeter further comprises a plurality of grooves separating a plurality of lobes, and wherein the arrow rest has a plurality of supporting fingers engaging the grooves.

8. The combination of claim 7, further comprising a spring biasing one of the supporting fingers against the arrow shaft.

9. The combination of claim 7, further comprising a ratchet adjustably biasing one of the supporting fingers against the arrow shaft.

10. The combination of claim 7, wherein the lobes and grooves spiral along the shaft, thereby imparting spin to the arrow as the arrow moves along the supporting fingers.

11. The combination of claim 10, wherein the shaft is tapered at the fletching portion to form a nock adapter, and further comprising a nock attachable to the nock adapter, the nock further comprising an enlarged portion, and further comprising a nock receiver for receiving the enlarged portion, the nock receiver being adapted for attachment to an archery bow string, the nock being rotatable within the nock receiver to allow the arrow to spin about its length.

12. The combination of claim 7, further comprising three lobes and three grooves.

13. The combination of claim 12, wherein the lobes are equidistantly spaced about the perimeter.

14. The combination of claim 7, wherein the shaft is hollow.

15. The combination of claim 7, wherein the shaft further comprises a non-fluted tip portion adapted to receive an arrowhead.

16. An arrow rest attachable to an archery bow and adapted to engage an arrow having a shaft with a fluted portion comprised of a plurality of lobes and separating grooves spiraling along the shaft to impart spin to the arrow as the arrow is released, the arrow rest comprising:

a) a base portion adapted to be attached to an archery bow;

b) a first supporting finger adapted to engage the arrow's fluted portion;

c) a spring adapted to bias the first supporting finger against the arrow's fluted portion;

d) a second supporting finger adapted to engage the arrow's fluted portion; and e) a ratchet adapted to adjustably bias the second supporting finger against the arrow's fluted portion.

* * * * *